US007424955B2

(12) United States Patent
Chen

(10) Patent No.: US 7,424,955 B2
(45) Date of Patent: Sep. 16, 2008

(54) PACKING STRUCTURE AND BUFFER DEVICE THEREOF

(75) Inventor: Heng-Hsiu Chen, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 477 days.

(21) Appl. No.: 11/187,940

(22) Filed: Jul. 25, 2005

(65) Prior Publication Data

US 2006/0021902 A1 Feb. 2, 2006

(30) Foreign Application Priority Data

Jul. 30, 2004 (TW) ..... 93123036 A

(51) Int. Cl.
*B65D 81/02* (2006.01)
*B65D 85/00* (2006.01)
*B65D 85/30* (2006.01)

(52) U.S. Cl. ..... 206/586; 206/453; 206/320

(58) Field of Classification Search ..... 206/586, 206/453, 320, 485, 784, 521, 701, 721, 723; 229/195, 198.2, 127, 131
See application file for complete search history.

(56) References Cited

U.S. PATENT DOCUMENTS 3,371,845 A * 3/1968 Freiman ..... 229/247
5,398,808 A * 3/1995 Chen et al. ..... 206/320
5,752,605 A * 5/1998 Cooper ..... 206/725
5,823,352 A * 10/1998 Mena et al. ..... 206/721
5,979,659 A * 11/1999 Kataoka ..... 206/588
6,675,970 B1 * 1/2004 Nemoto ..... 206/521
7,303,071 B2 * 12/2007 Saito ..... 206/320

* cited by examiner

*Primary Examiner*—J. Gregory Pickett
(74) *Attorney, Agent, or Firm*—Birch, Stewart, Kolasch & Birch, LLP

(57) ABSTRACT

A buffer device comprises a buffer member, a lateral side, a first supporting board and a second supporting board. In this case, the buffer member is formed with at least one folded baseboard. The lateral side is located at one side of the buffer member and has a first edge and a second edge. One side of the first supporting board is joined to the first edge and a first portion of the first supporting board covers at least one part of the lateral side. A second portion of the first supporting board is substantially perpendicular to the first portion and is folded to insert into the lateral side. One side of the second supporting board is joined to the second edge and a third portion of the second supporting board covers at least one part of the lateral side. A fourth portion of the first supporting board is substantially perpendicular to the third portion and is folded to insert into the lateral side.

20 Claims, 7 Drawing Sheets

131 } 13
132

141 } 14
142

PACKING STRUCTURE AND BUFFER DEVICE THEREOF

BACKGROUND OF THE INVENTION

1. Field of Invention

The invention relates to packing structure and, in particular, to a packing structure includes buffer devices providing a buffering function.

2. Related Art

With great progress in technology, electronic products such as computers have already become the indispensable equipments in the modem live. However, the electronic apparatus is very easy to be damaged on the shipping way because of their highly delicate and weakness, so manufacturers usually assemble the product with protective packing structure to support and protect them against, for example, water, dust and strike force from the environment.

The conventional packing box is filled with buffer materials such as foam plastics or buffer pads for protecting the shipped products from colliding with the wall of the packing box when the products are shaken in shipment. However, with raising of the environmental consciousness, the disposing of the plastic buffering materials is not fit for the policy of the environmental protection in every country because it makes a burden of the environmental ecology.

Consequentially, basing on the principle of the environmental protection, many areas use cardboards, which can be made of recyclable pulp and can be recycled again, as the material of the packing structure for reducing the cost and eliminating the impacts on the environmental ecology.

However, the protective effect of the paper packing structure against the colliding stress is not as good as the plastic packing structure. Additionally, the assembling process of the paper packing structure, which has many pieces of cardboards, is complicated.

Therefore, it is a subject to provide a paper packing structure, which can buffer the colliding stress and are easily assembled.

SUMMARY OF THE INVENTION

In view of the foregoing, the invention is to provide a packing structure and a buffer device thereof that are easily assembled and can buffer the colliding stress.

To achieve the above, a buffer device of the invention includes a buffer member, a lateral side, a first supporting board, and a second supporting board. In this invention, the buffer member is formed with at least one folded baseboard. The lateral side is located at one side of the buffer member and has a first edge and a second edge. One side of the first supporting board is joined to the first edge. A first portion of the first supporting board covers at least one part of the lateral side, and a second portion of the first supporting board is substantially perpendicular to the first portion and is folded to insert into the lateral side. One side of the second supporting board is joined to the second edge. A third portion of the second supporting board covers at least one part of the lateral side, and a fourth portion of the second supporting board is substantially perpendicular to the third portion and is folded to insert into the lateral side.

Additionally, to achieve above, a packing structure of the invention includes a plurality of buffer devices and a bearing element. In this invention, each of the buffer devices includes a buffer member, a lateral side, a first supporting board, and a second supporting board. The buffer member is formed with at least one folded baseboard. The lateral side is located at one side of the buffer member and has a first edge and a second edge. One side of the first supporting board is joined to the first edge. A first portion of the first supporting board covers at least one part of the lateral side, and a second portion of the first supporting board is substantially perpendicular to the first portion and is folded to insert into the lateral side. One side of the second supporting board is joined to the second edge. A third portion of the second supporting board covers at least one part of the lateral side, and a fourth portion of the second supporting board is substantially perpendicular to the third portion and is folded to insert into the lateral side. The buffer devices are fastened to two sides of the bearing element.

As mentioned above, the packing structure is assembled with a plurality of buffer devices and can effectively buffer the stress so as to bear and protect electronic products on shipment. This buffer device is assembled with joining the first supporting board and the second supporting board to the buffer member and then covering the lateral side of the buffer member. In addition, it is possible to form a first buffer breach and a second buffer breach on the corner of the lateral side to buffer stress significantly. Moreover, for enhancing the effect of buffering stress, at least one cut line and slots having a circled end are formed on the buffer member.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
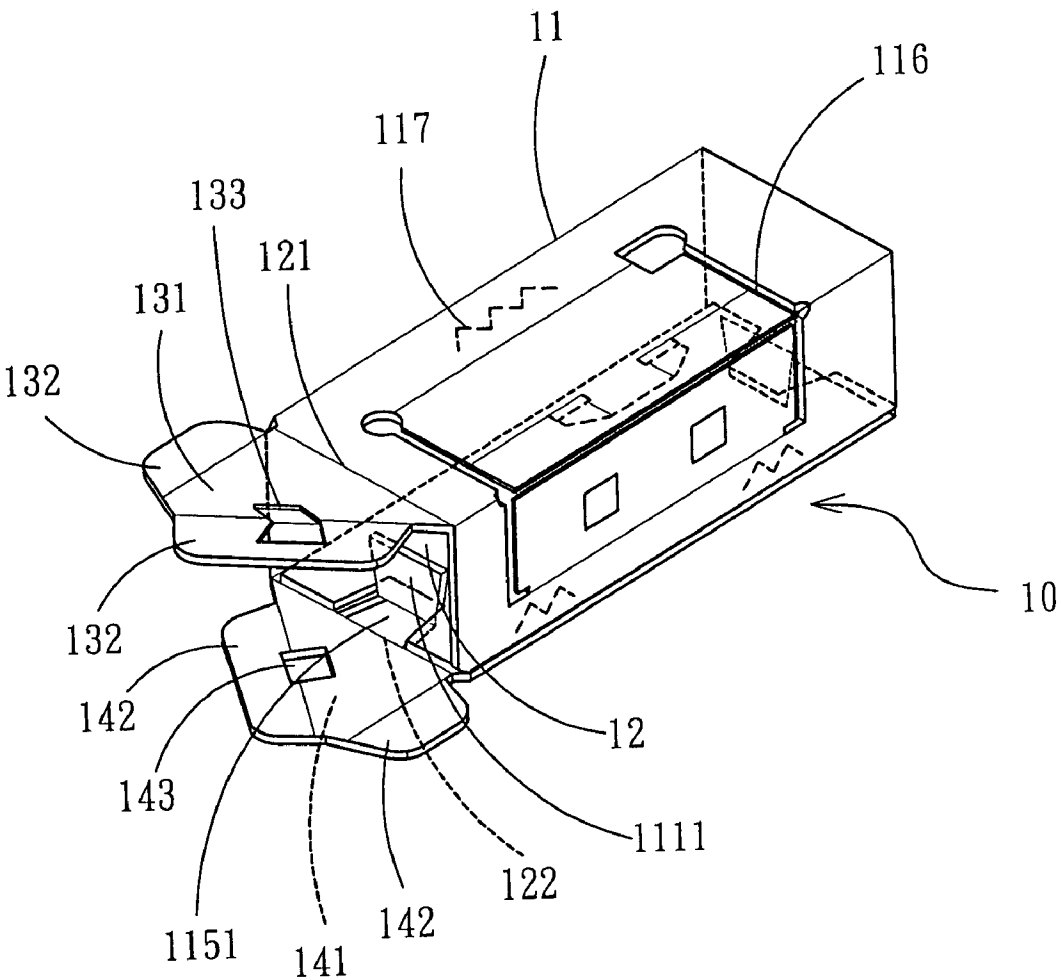
FIG. 1 is a schematic view showing a buffer device according to a preferred embodiment of the invention.

With reference to FIG. 1, a buffer device 10 according to the preferred embodiment of the invention comprises a buffer member 11, a lateral side 12, a first supporting board 13, and a second supporting board 14.

The buffer member 11 is formed with at least one folded baseboard. The lateral side 12 is located at one side of the buffer member 11 and has a first edge 121 and a second edge 122. One side of the first supporting board 13 is joined to the first edge 121. The first supporting board 13 has a first portion 131 and a second portion 132. One side of the second supporting board 14 is joined to the second edge 122. The second supporting board 14 has a third portion 141 and a forth portion 142.

In the present embodiment, the lateral side 12 formed at one side of the buffer member 11 can be a rectangular opening. The first edge 121 and the second edge 122 are set on the fringes of the rectangular opening and are opposite to one another. The first portion 131 of the first supporting board 13 and the third portion 141 of the second supporting board 14 can be in triangle shapes.

Figure 2:
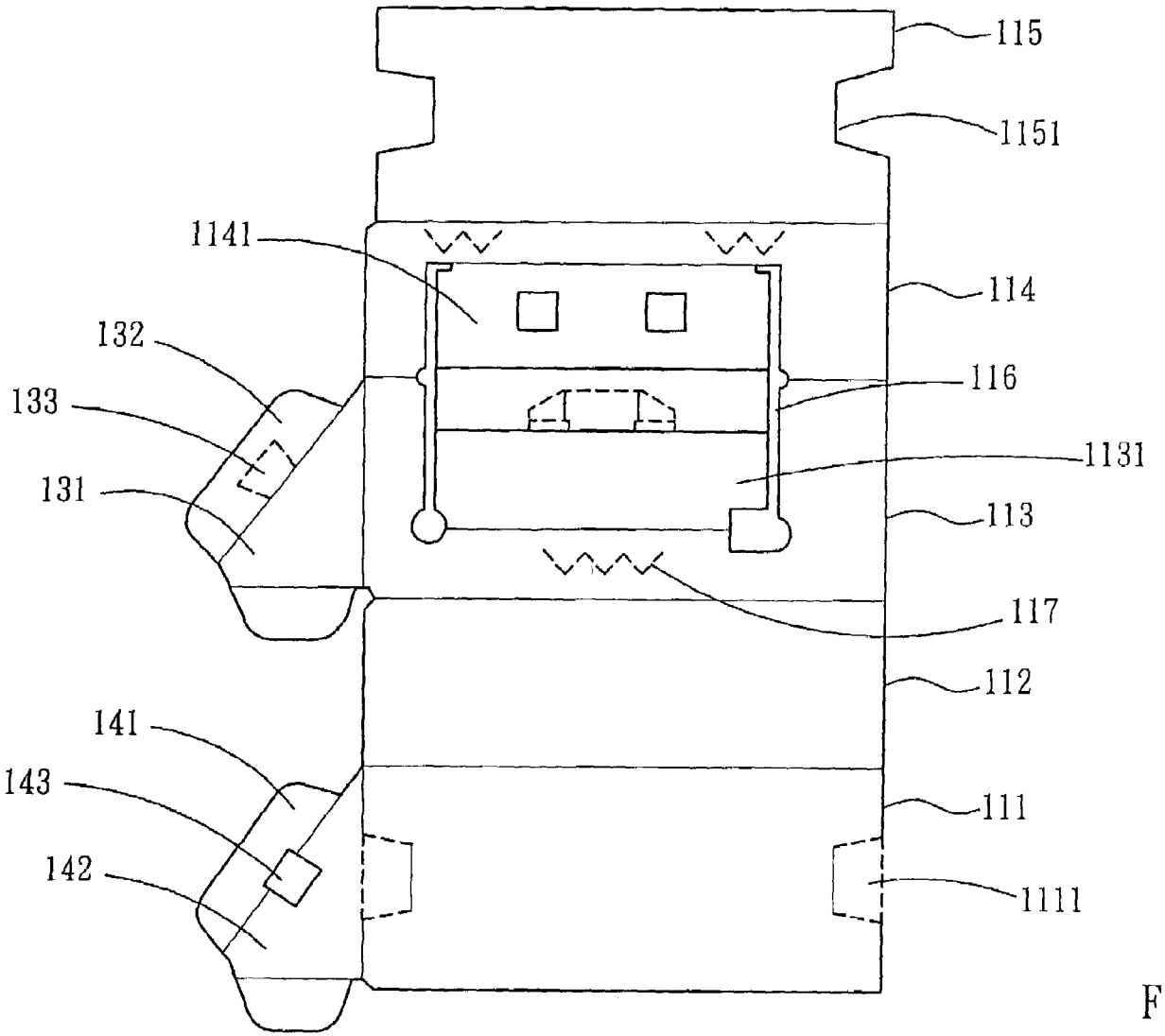
FIG. 2 is a schematic development view showing the buffer device according to a preferred embodiment of the invention.

With reference to FIG. 2, the buffer member 11 formed with at least one folded baseboard comprises a first baseboard 111, a second baseboard 112, a third baseboard 113, a forth baseboard 114, and a fifth baseboard 115.

As mentioned above, one side of the second baseboard 112 is joined to the first baseboard 111. Besides, the first baseboard 111 and the second baseboard 112 are foldable along a junction of the first baseboard 111 and the second baseboard 112. One side of the third baseboard 113 is joined to the second baseboard 112. The second baseboard 112 and the third baseboard 113 are foldable along a junction of the second baseboard 112 and the third baseboard 113. One side of the forth baseboard 114 is joined to the third baseboard 113. The third baseboard 113 and the fourth baseboard 114 are foldable along a junction of the third baseboard 113 and the fourth baseboard 114. One side of the fifth baseboard 115 is joined to the fourth baseboard 114. The fourth baseboard 114 and the fifth baseboard 115 are foldable along a junction of the fourth baseboard 114 and the fifth baseboard 115. Moreover, the above-mentioned junctions are parallel to each other and these baseboards are made of cardboards. Consequentially, the buffer member 11 is formed by way of connecting the fifth baseboard 115 to the first baseboard 111 (as shown in FIG. 1).

As mentioned above, the first baseboard 111 has a baffle flap 1111 and the fifth baseboard 115 has a fastened hole 1151. For connecting the first baseboard 111 to the fifth baseboard 115, the baffle flap 1111 is inserted into the fastened hole 1151.

Figure 3:
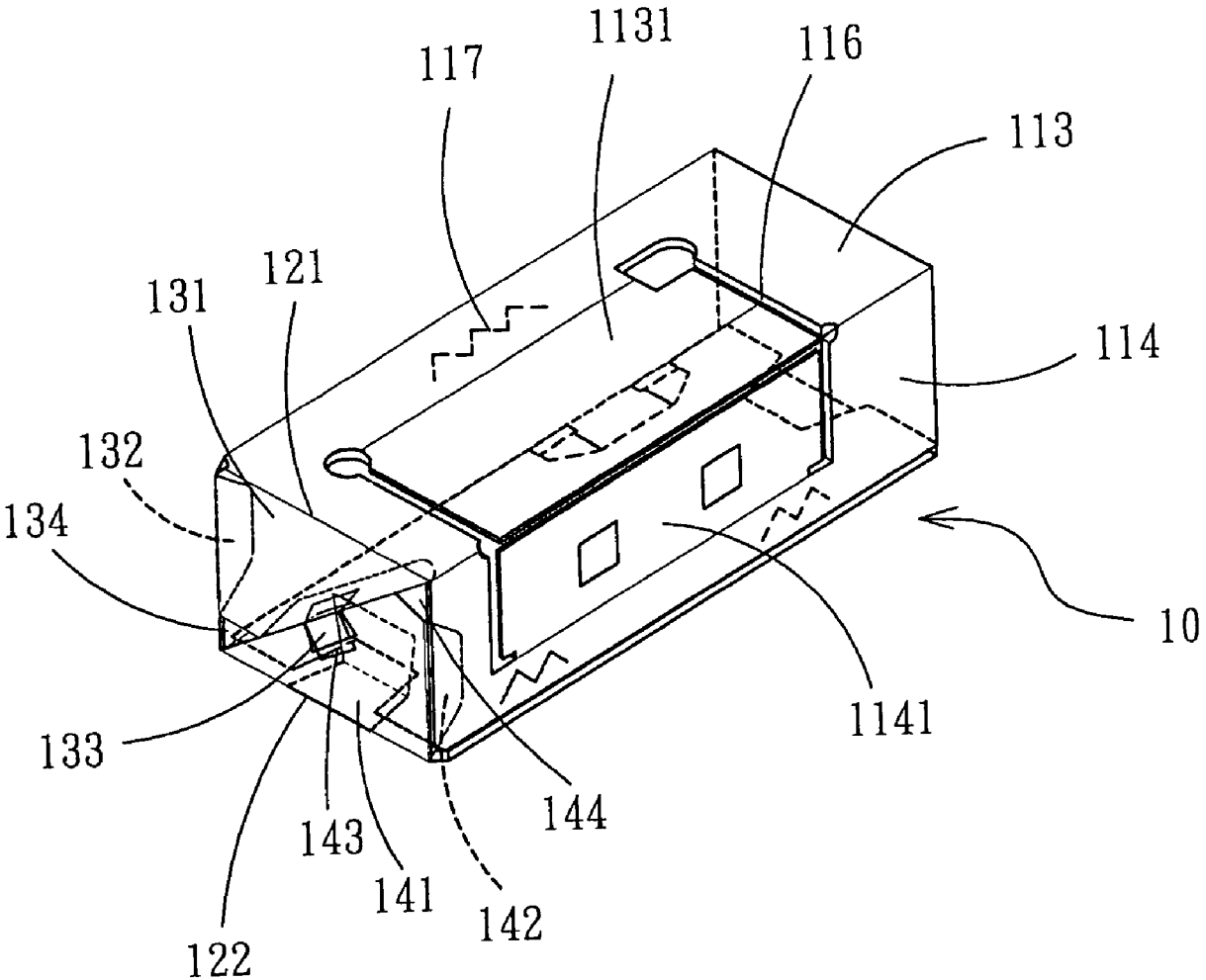
FIG. 3 is a schematic view showing a folded buffer member of the buffer device according to a preferred embodiment of the invention.

With reference to FIG. 3, the second portion 132 of the first supporting board 13 and the first portion 131 of the first supporting board 13 are foldable, and the first portion 131 of the first supporting board 13 is foldable along the first edge 121. When the first baseboard 111 and the fifth baseboard 115 have connected and the second portion 132 have folded to insert into the lateral side 12, the first portion 131 covers at least one portion of the lateral side 12. Then, the first portion 131 is substantially perpendicular to the second portion 132. Similarly, the forth portion 142 of the second supporting board 14 and the third portion 141 of the second supporting board 14 is foldable, and the third portion 141 of the second supporting board 14 is foldable along the second edge 122. When the forth portion 142 have folded to insert into the lateral side 12, the third portion 141 also covers at least one portion of the lateral side 12. Then, the third portion 141 is substantially perpendicular to the forth portion 142.

In conclusion, the first portion 131 of the first supporting board 13 and the third portion 141 of the second supporting board 14 are connected to the first edge 121 and the second edge 122, respectively. By folding the second portion 132 and the forth portion 142 to insert into the lateral side 12, the first portion 131 and the third portion 141 are connected with each other and cover the lateral side 12 jointly.

In addition, with reference to FIG. 1, the first supporting board 13 further has a flap 133 and the second supporting board 14 further has a hole 143. The flap 133 is inserted into the hole 143, so that the first supporting board 13 faces and connects to the second supporting board 14.

In the present embodiment, the first supporting board 13 and the second supporting board 14 respectively have a first buffer breach 134 and a second buffer breach 144. When the first supporting board 13 and the second supporting board 14 cover the lateral side 12 jointly, the first buffer breach 134 is formed on a corner of the lateral side 12 and the second buffer breach 144 is formed on another corner of the lateral side 12 (as shown in FIG. 3). These buffer breaches 134 and 144 are used to buffer the outside stress.

Figure 4:
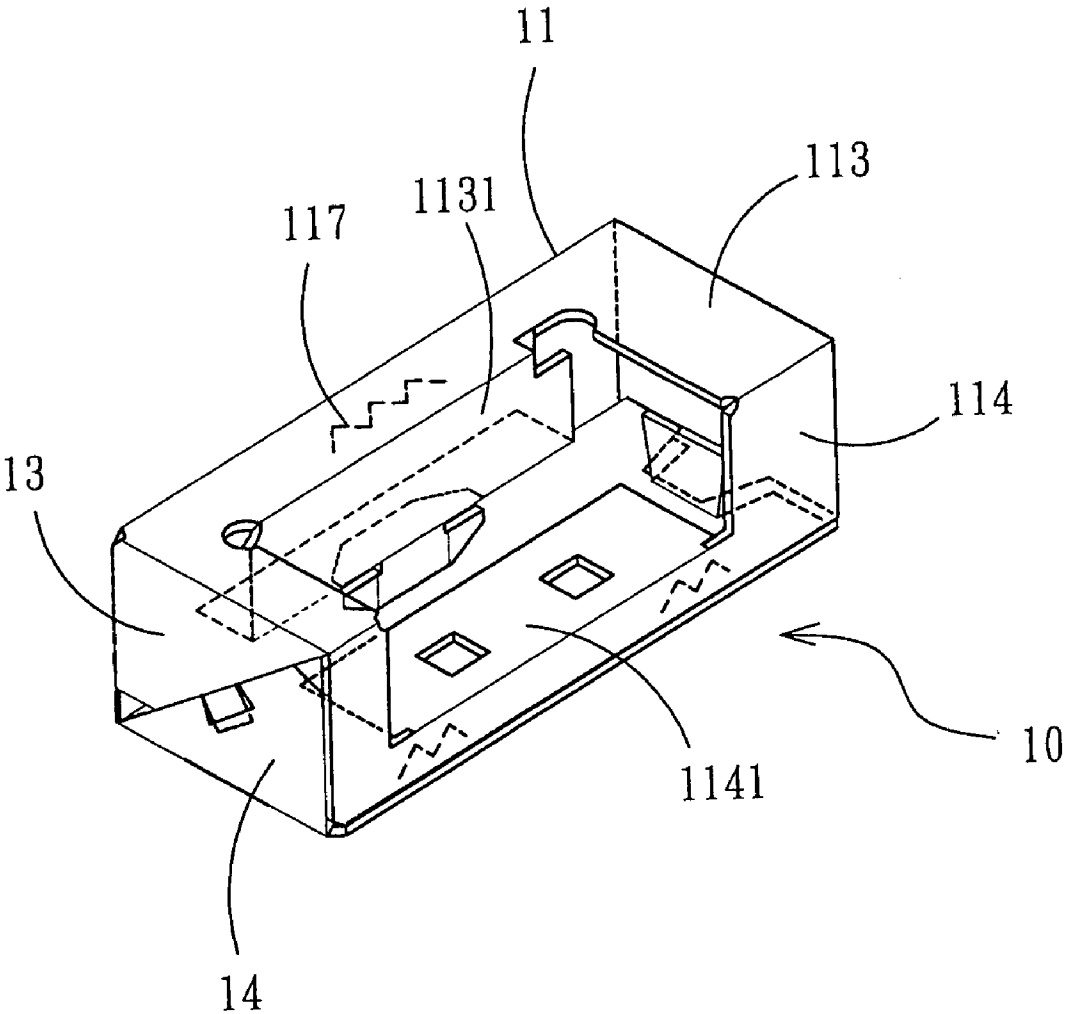
FIG. 4 is a schematic view showing a folded buffer device according to a preferred embodiment of the invention.

In addition, with reference to FIG. 3, a pair of slots 116 is formed perpendicularly to the junction of the third baseboard 113 and the fourth baseboard 114. The slots 116 are parallel to each other. With reference to FIG. 4, as a result of forming these slots, a part of the third baseboard 113 forms a first tongue flap 1131 defined by those slots 116 and a part of the forth baseboard 114 forms a second tongue flap 1141 defined by those slots 116. When the fifth baseboard 115 and the first baseboard 111 are connected to form a buffer member 11, the first tongue flap 1131 and the second tongue flap 1141 are foldable inwardly to form a mounting base.

Additionally, one end of each slot 116 is a circled end. The buffer device 10 further comprises at least one cut line 117 formed on the buffer member 11. The cut line 117 can be a curve line, a wavy line, or a saw-toothed line. The designs of the circle ends of the slots 116 and the cut line 117 are used for releasing the stress so as to improve the effect of buffering stress.

Figure 5:
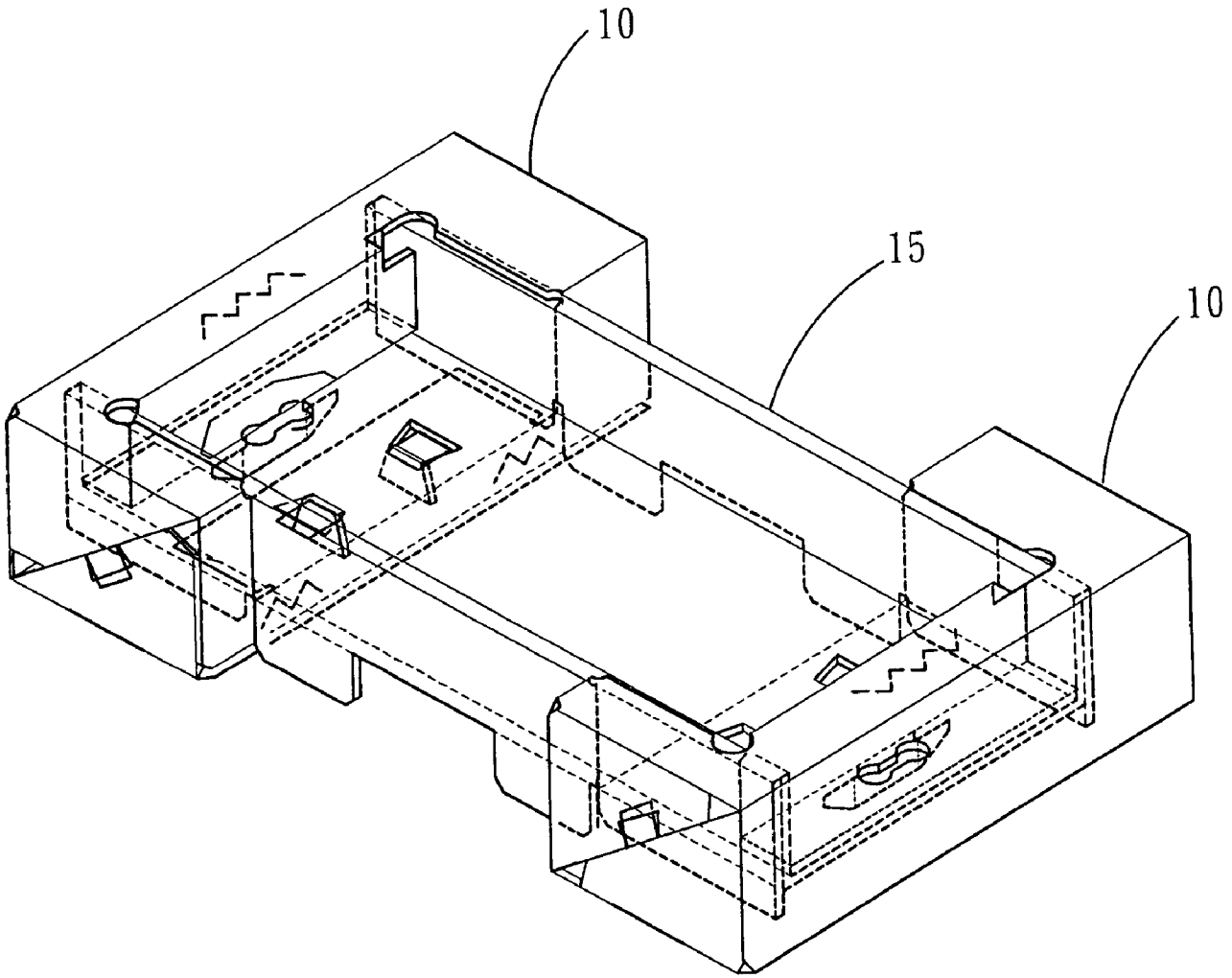
FIG. 5 is a schematic view showing a packing structure according to a preferred embodiment of the invention.

With reference to FIG. 5, a packing structure 1 according to the preferred embodiment of the invention comprises a plurality of buffer devices 10 and a bearing element 15. In this case, the buffer devices 10 are fastened to two sides of the bearing element 15 so as to assemble the packing structure 1.

Figure 6:
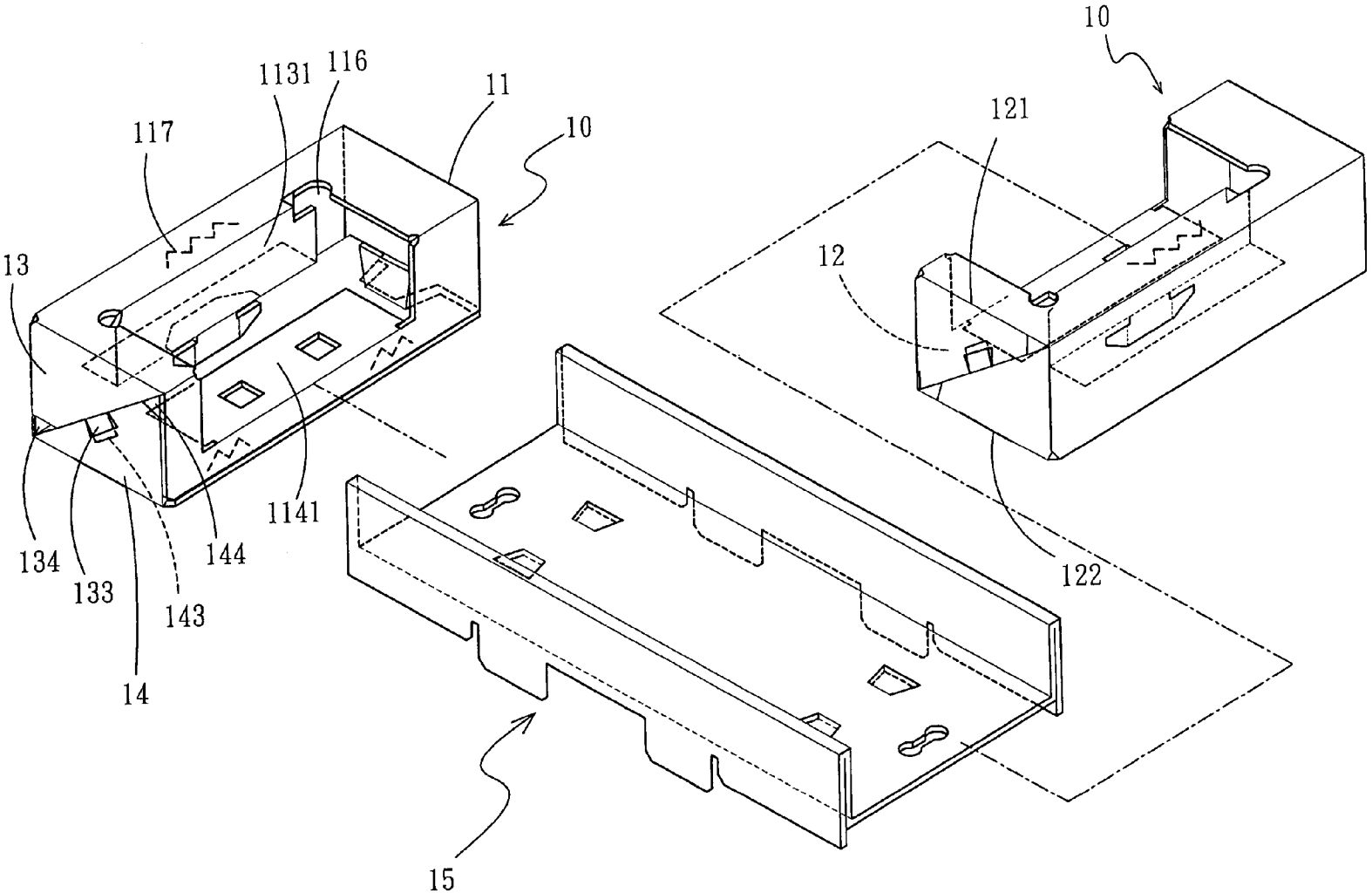
FIG. 6 is a schematic exploded view showing the packing structure according to a preferred embodiment of the invention.
Figure 7:
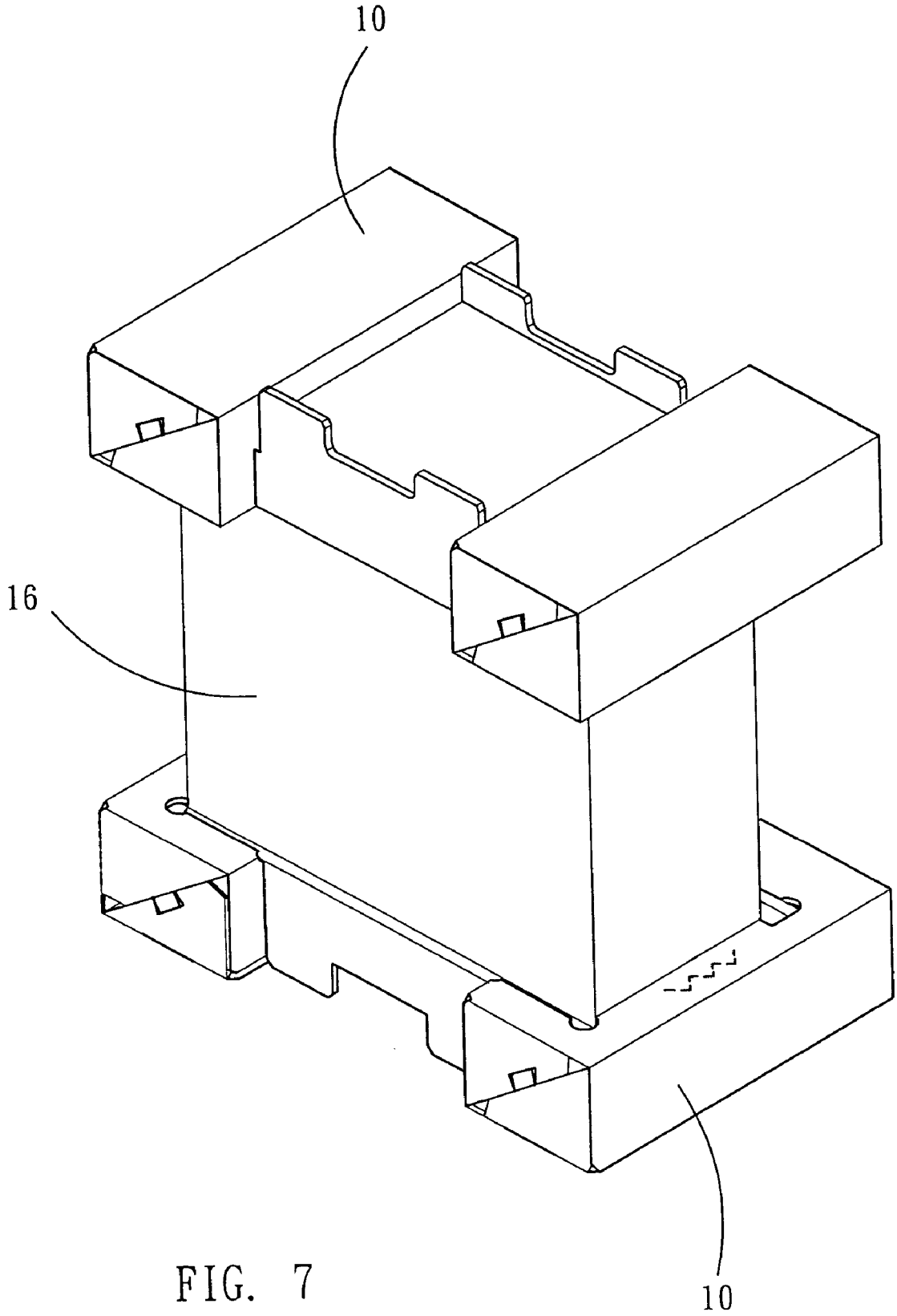
FIG. 7 is a schematic view showing the packing structure according to a preferred embodiment of the invention that is in use.

In the present embodiment, the structures and the materials of the buffer devices 10 of the packing structure 1 are the same as those previously mentioned, so the detailed descriptions are omitted for concise purpose. To be noted that the laterals of the bearing element 15 are respectively fastened to the mounting base of each buffer device 10 (as shown in FIG. 6). The bearing element 15 is used to hold a product 16 to be transported. Using a pair of the packing structures to cover the top and bottom sides or the left and right sides of the product 16 can protect it from colliding stress in shipment (as shown in FIG. 7). As the packing structure 1 sheathes the laterals of the product 16, the packing structure 1 does not limit to the transported product's size. Consequently, the packing structure 1 can be applied to different sizes of products to be transported.

In conclusion, the buffer device is characterized in using the first supporting board and the second supporting board, which are both connected to the buffer member, face to each other and cover the lateral side of the buffer member. In addition, the corners of lateral side form the first buffer breach and the second buffer breach. Therefore, the buffer device can buffer the stress significantly. Moreover, in this case, at least one cut line and a slot having a circled end are formed on the buffer member to enhance the effect of buffering stress.

Therefore, a packing structure assembled with the buffer devices can be applied to package products to be transported for achieving the objective of protecting products by buffering the colliding stress. Moreover, since the buffer device can be made of cardboards, the assembling process of the buffer device is easier and the objective of environmental protection is achieved. Consequently, the invention further achieves the demand of decreasing manufacturing cost.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A buffer device, comprising:

a buffer member formed with at least one folded baseboard, comprising:

a first baseboard, a second baseboard, a third baseboard, a fourth baseboard and a fifth baseboard, the second baseboard is joined to the first baseboard, the third baseboard is joined to the second baseboard, the forth baseboard is joined to the third baseboard, the fifth baseboard is joined to the fourth baseboard, the first baseboard and the second baseboard are foldable along a junction of the first baseboard and the second baseboard, the second baseboard and the third baseboard are foldable along a junction of the second baseboard and the third baseboard, the third baseboard and the fourth baseboard are foldable along a junction of the third baseboard and the fourth baseboard, the fourth baseboard and the fifth baseboard are foldable along a junction of the fourth baseboard and the fifth baseboard, the junctions are parallel to each other, and the fifth baseboard is connected to the first baseboard;

a lateral side located at one side of the buffer member and having a first edge and a second edge;

a first supporting board, wherein one side of the first supporting board is joined to the first edge, a first portion of the first supporting board covers at least one part of the lateral side, and a second portion of the first supporting board is substantially perpendicular to the first portion and is folded to insert into the lateral side; and a second supporting board, wherein one side of the second supporting board is joined to the second edge, a third portion of the second supporting board covers at least one part of the lateral side, and a fourth portion of the second supporting board is substantially perpendicular to the third portion and is folded to insert into the lateral side, wherein a pair of slots are formed on the third baseboard and the fourth baseboard, are perpendicular to the junction of the third baseboard and the fourth baseboard and are parallel to each other, the third baseboard includes a first tongue flap defined by the slots, the fourth baseboard includes a second tongue flap defined by the slots, and the first tongue flap and the second tongue flap are foldable inwardly to form a mounting base.

2. The buffer device of claim 1, wherein the first portion adjoins to the third portion, and the first portion and the third portion cover the lateral side.

3. The buffer device of claim 1, wherein the first edge and the second edge are set on the fringes of the lateral side and are opposite to one another.

4. The buffer device of claim 1, wherein the lateral side is a rectangle opening, the first edge and the second edge are set on the fringes of the rectangle opening, the first portion and the third portion are in triangle shapes and cover the lateral side, the second portion is joined to the edge of the first portion, the fourth portion is joined to the edge of the third portion, and the second portion and the fourth portion are folded to insert into the rectangle opening.

5. The buffer device of claim 1, further comprising: at least one cut line formed on the buffer member for releasing stress.

6. The buffer device of claim 1, wherein the first supporting board has a flap, the second supporting board has a hole, the flap is inserted into the hole to connect the first supporting board to the second supporting board.

7. The buffer device of claim 1, wherein the first baseboard of the buffer member has a baffle flap, the fifth baseboard has a fastened hole, and the baffle flap is inserted into the fastened hole to connect the first baseboard to the fifth baseboard.

8. The buffer device of claim 1, wherein the first supporting board has a first buffer breach formed on a corner of the lateral side when the first supporting board and the second supporting board cover the lateral side.

9. The buffer device of claim 1, wherein the second supporting board has a second buffer breach formed on a corner of the lateral side when the first supporting board and the second supporting board cover the lateral side.

10. A packing structure, comprising:

a plurality of buffer devices, wherein each of the buffer devices comprises: a buffer member formed with at least one folded baseboard, a lateral side located at one side of the buffer member and having a first edge and a second edge, a first supporting board, wherein one side of the first supporting board is joined to the first edge, a first portion of the first supporting board covers at least one part of the lateral side, and a second portion of the first supporting board is substantially perpendicular to the first portion and is folded to insert into the lateral side, and a second supporting board, wherein one side of the second supporting board is joined to the second edge, a third portion of the second supporting board covers at least one pat of the lateral side, and a fourth portion of the second supporting board is substantially perpendicular to the third portion and is folded to insert into the lateral side; and a bearing element, wherein the buffer devices are fastened to two sides of the bearing element.

11. The packing structure of claim 10, wherein the first portion adjoins to the third portion, and the first portion and the third portion cover the lateral side.

12. The packing structure of claim 10, wherein the first edge and the second edge are set on the fringes of the lateral side and are opposite to one another.

13. The packing structure of claim 10, wherein the lateral side is a rectangle opening, the first edge and the second edge are set on the fringes of the rectangle opening, the first portion and the third portion are in triangle shapes and cover the lateral side, the second portion is joined to the edge of the first portion, the fourth portion is joined to the edge of the third portion, and the second portion and the fourth portion are folded to insert into the rectangle opening.

14. The packing structure of claim 10, further comprising: at least one cut line formed on the buffer member for releasing stress.

15. The packing structure of claim 10, wherein the first supporting board has a flap, the second supporting board has a hole, the flap is inserted into the hole to connect the first supporting board to the second supporting board.

16. The packing structure of claim 10, wherein the buffer member comprises a first baseboard, a second baseboard, a third baseboard, a fourth baseboard and a fifth baseboard, the second baseboard is joined to the first baseboard, the third baseboard is joined to the second baseboard, the forth baseboard is joined to the third baseboard, the fifth baseboard is joined to the fourth baseboard, the first baseboard and the second baseboard are foldable along a junction of the first baseboard and the second baseboard, the second baseboard and the third baseboard are foldable along a junction of the second baseboard and the third baseboard, the third baseboard and the fourth baseboard are foldable along a junction of the third baseboard and the fourth baseboard, the fourth baseboard and the fifth baseboard are foldable along a junction of the fourth baseboard and the fifth baseboard, the junctions are parallel to each other, and the fifth baseboard is connected to the first baseboard.

17. The packing structure of claim 16, wherein a pair of slots are formed on the third baseboard and the fourth baseboard, are perpendicular to the junction of the third baseboard and the fourth baseboard and are parallel to each other, the third baseboard includes a first tongue flap defined by the slots, the fourth baseboard includes a second tongue flap defined by the slots, and the first tongue flap and the second tongue flap are foldable inwardly to form a mounting base.

18. The packing structure of claim 16, wherein the first baseboard of the buffer member has a baffle flap, the fifth baseboard has a fastened hole, and the baffle flap is inserted into the fastened hole to connect the first baseboard to the fifth baseboard.

19. The packing structure of claim 10, wherein the first supporting board has a first buffer breach formed on a corner of the lateral side when the first supporting board and the second supporting board cover the lateral side.

20. The packing structure of claim 10, wherein the second supporting board has a second buffer breach formed on a corner of the lateral side when the first supporting board and the second supporting board cover the lateral side.

* * * * *